United States Patent [19]

Bolen

[11] 4,414,710

[45] Nov. 15, 1983

[54] TEXTILE CARDING MACHINE FEED ASSEMBLY AND METHOD

[76] Inventor: George F. Bolen, 107 Rockwood Dr., Greenville, S.C. 29605

[21] Appl. No.: 292,932

[22] Filed: Aug. 14, 1981

Related U.S. Application Data

[63] Continuation-in-part of Ser. No. 959,227, Nov. 9, 1978, abandoned.

[51] Int. Cl.[3] ..... D01G 15/40
[52] U.S. Cl. ..... 19/105
[58] Field of Search ..... 19/105, 204

[56] References Cited

U.S. PATENT DOCUMENTS 3,218,676 11/1965 Lenk ..... 19/105
4,222,154 9/1980 Stäheli ..... 19/105

*Primary Examiner*—Louis Rimrodt
*Attorney, Agent, or Firm*—Dority & Flint

[57] ABSTRACT

A feed assembly and method for a carding machine is disclosed which includes a series of individual presser levers 22 pivotably carried adjacently above of a feed roll 16 on a carding machine frame 10 to which a lap 14 of fibers is fed via a feed plate 12. The presser levers incrementally apply an even pressure to the lap so that control of the fibers on the feed roll is maintained as they are grabbed off by a licker-in 18.

3 Claims, 2 Drawing Figures

TEXTILE CARDING MACHINE FEED ASSEMBLY AND METHOD

This is a continuation-in-part of co-pending application Ser. No. 959,227, filed Nov. 9, 1978 entitled Textile Carding Machine Feed Assembly, now abandoned.

BACKGROUND OF THE INVENTION

Feed assemblies for textile carding machines have been heretofore utilized to perform the general function of feeding fibers of various length to an opening roll commonly referred to as a licker-in and at the same time maintain control of unopened tufts and lumps to prevent plucking and jerk-ins. The assemblies typically have included a feed plate or table terminating in a concave trough adjacent the lickerin in which a feed roll is supported. A gap is defined between the feed roll and feed plate between which the fibers are fed. This type feed assembly is used for carding cotton and synthetic fibers up to and including 2½ inches in length, but cannot be used with any degree of satisfaction when carding long staple synthetic fibers due to excessive breakage. Regard-applied. Two type feed rolls are utilized for this type of assembly both of which serve the same purpose, namely fluted and spirally wound serrated metallic wire.

Another prior feed assembly consists of two metallic wire wound feed rolls and a feed roll clearer and is used when carding long staple synthetic fibers. The fiber is fed to lickerin by the feed rolls and the clearer is there to prevent fibers wrapping around the feed rolls. This type is reasonably effective in preventing jerk-ins, but is ineffective in providing a good combing action due to lack of control of fibers.

However, in the event a heavy mass of fibers is concentrated in the form of a lump in a small area of the lap, the two prior feed assemblies heretofore described will allow jerk-in of irregular fiber masses. This is due to the deflections of feed roll and feed plate as the lump passes therebetween which results in loss of control over the fibers since they are no longer held tightly between the feed roll and plate and can be jerked in by the licker-in. In an attempt to exert and maintain control extreme pressures have been used between the feed roll and feed plate. However, if the fibers are held too tightly, they are broken when grabbed at by the licker-in. All of which adversely affects the quality of the fiber web being carded and can result in damage to the various rolls and clothing on the carding machine.

A feed device has been proposed in U.S. Pat. No. 4,222,154 wherein a uniform fiber thickness delivered between the feed roll and feed plate is provided by a presser plate 20 which compresses the fibers prior to feeding by the feed assembly. However, lump fiber masses can still be released between the feed roll and plate after compression still posing the problem of jerk-ins because of loss of fiber control.

Accordingly, an important object of the present invention is to provide a feed assembly and method for a carding machine which improves the quality of the web being carded by the elimination of fiber jerk-ins or plucking as a result of better fiber control and combing action.

Still another important object of the present invention is to provide feed assembly for a carding machine which increases the quality of the web being carded by providing better separation of cotton fibers and undesirable impurities.

Still another important object of the present invention is to provide a feed assembly for a carding machine which improves the efficiency of the carding machine by reducing the number of carding machine stops by eliminating fiber jerk-ins.

Still another important object of the present invention is to provide a feed assembly for a carding machine which is versatile and can be used for long and short staple fibers without an increase in fiber breakage and may be adapted to picker lap or chute feed systems.

Still another important object of the present invention is to provide a feed assembly for a carding machine which reduces maintenance costs by eliminating fiber jerk-ins and resulting clothing damage to licker-in, main cylinder, carding flats, and doffer roll.

SUMMARY OF THE INVENTION

The above objectives are accomplished according to the present invention by mounting a plurality of spring loaded presser levers above the feed roll which apply equal pressure to the full length of the feed roll and thus the fiber layer passing therebetween thus holding the fiber layer against the feed roll and effectively controlling the fiber in the area at which the licker-in grasps the fibers assuring that large fiber masses are not jerked in accidentally. Better combing action between the feed roll and licker-in is provided due to the fibers being held by the feed roll in a controlled manner just prior to being grabbed by the licker-in.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention may be utilized on any conventional carding machine for feeding a fiber layer or lap to the carding machine. Since the features of a carding machine are well known in the art, only those portions of a carding machine that are necessary to an understanding of the invention are illustrated. Accordingly, only an end of a carding machine frame is illustrated at which the feed in of fibers occurs.

Figure 1:
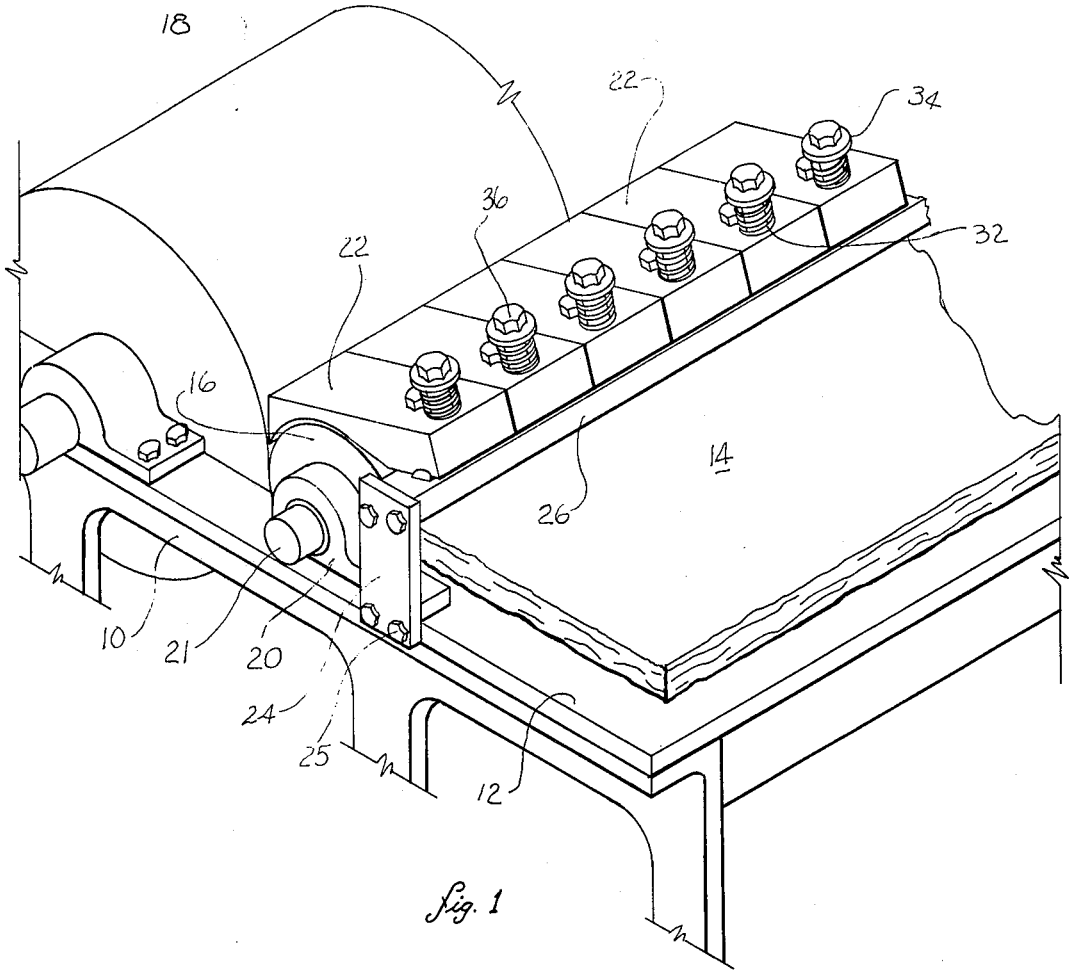
FIG. 1 is a perspective view illustrating the feed assembly constructed in accordance with the present invention.
Figure 2:
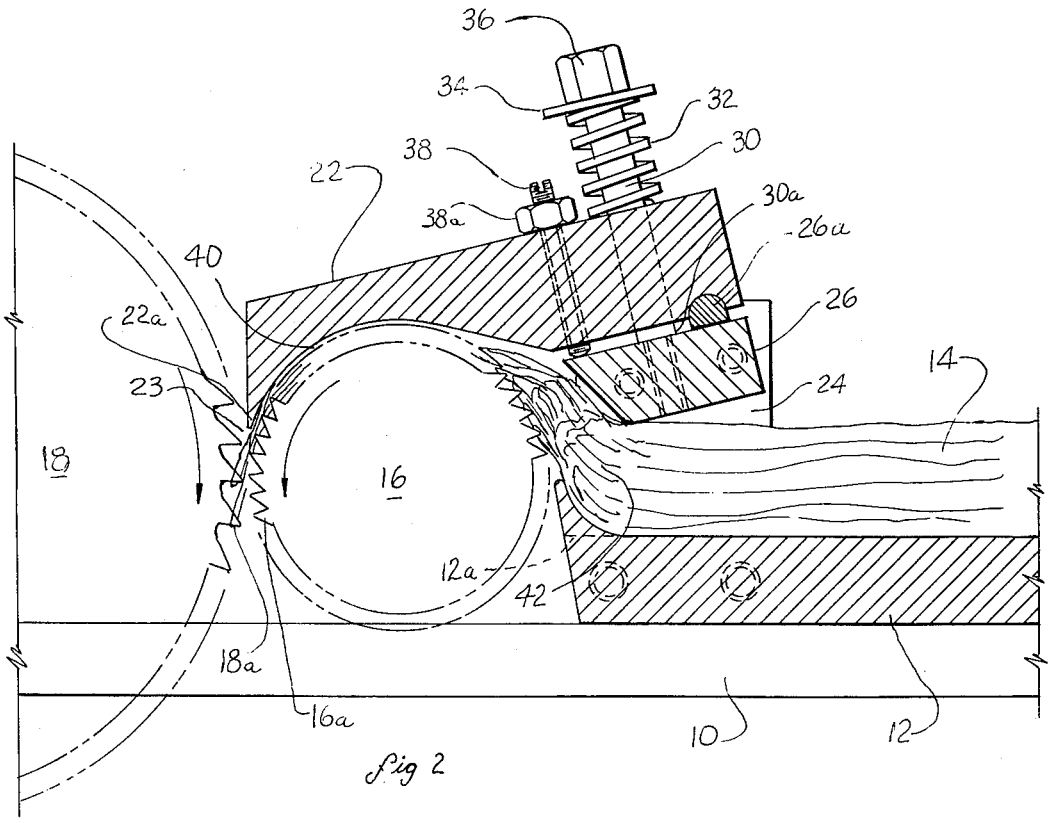
FIG. 2 is a schematic illustration illustrating the feed assembly and method according to the present invention.

Referring now in more detail to the drawing, a carding machine frame is illustrated at 10 which supports a feed plate 12 on which a layer of fibers, commonly referred to as a fiber lap, is shown at 14. A conventional feed roll 16 is mounted adjacent the feed plate 12 as best seen in FIG. 2. Adjacent the feed roll a conventional opening roll, commonly referred to as a licker-in 18 is carried. The licker-in grabs the fibers off of the feed roll 16 in a combing action and further opens the fiber tufts prior to delivering fibers to the main cylinder for carding. Both the feed roll and licker-in typically include metallic wire teeth clothing at 16*a* and 18*a*, respectively. The teeth of the licker-in reduce fiber tufts present in the lap to a state approaching individual fibers.

The feed roll 16 is carried by means of a bearing block 20 fixed to the frame 10 of the carding machine adjacent each end thereof in which a feed roll shaft 21 is rotatably journaled. A portion of the feed plate is cut away at 12*a* to remove a portion of the nose 12*b* so that the bearing block 20 may be affixed directly to the feed plate. In a conventional machine the feed roll is typically supported above the feed plate in the area of the trough 12*c* of the feed plate. However, in the present case, the feed plate is displaced rearwardly and delivers fibers over the top of the feed roll as shown necessitating mounting of the support bearings at the nose.

Presser means for pressing the fibers against the feed roll segmentally and individually across the width of the lap fibers whereby the fibers are held and controlled right up until the transfer area 23 is provided by a series of spring loaded press levers 22 carried above the feed roll across the entire length thereof and width of the carding machine. In a preferred embodiment, the press levers 22 are approximately two inches wide and approximately seven inches in length for a four inch diameter feed roll. The press levers are carried by means of an upstanding bracket member 24 affixed to the side of feed plate 12 by suitable means such as bolts 25. A horizontal mounting bar 26 is affixed to the upstanding bracket 24 by any suitable means such as bolts or welding. The individual presser levers 22 are then affixed to the mounting bar 26 as can best be seen in FIG. 2 by means of a threaded stud 30. The bolt 30 is affixed at one end within the mounting bar 26 at a shoulder portion 30*a* and includes a biasing spring 32 and a washer 34 secured by means of a bolt head 36 of the bolt 30. The presser levers rock on a raised fulcrum portion 26*a* which is an integral or one-piece part of bar 26. The spring 32 urges at its opposing end against the back of the presser lever 22 to bias same counterclockwise about fulcrum 26*a*. The biasing force may be varied by using different springs.

Stop means is provided by an adjustable threaded rod 38 bearing against support bar 26 such that the presser lever may be set with a gap 40 being of a pre-set minimum thickness. In this way contact between the wire clothing on the feed roll and the presser levers may be avoided to eliminate any chances of damage to the wire clothing. A set screw 38*a* locks rod 38 in place. As the fiber layer 14 is fed along the feed plate it enters a nip 42 between the feed plate and the transverse mounting bar whereby the layer is uniformly compressed. Subsequently, the fiber layer is held against the feed roll under compression by the presser levers 22 and the biasing spring 32. Much less pressure is required than is required with conventional feed plate and feed roll which, in turn, reduces fiber breakage. The presser levers act much in the manner of piano keys in allowing any lump masses in the lap to pass thereunder without raising adjacent presser lever off of the remaining lap. An even pressure is applied across the width of the lap regardless of lumps and thickness variations. Thus, the fibers are held between the feed roll and presser levers with just the correct amount of pressure along the entire feed roll whereby control of the fibers is maintained right up to the point 23 at which the licker-in grabs the fibers. For this purpose, presser lever 22 terminates in a nose 22*a* which extends right into this fiber transfer area to control the fibers thereat.

In this manner, the fibers are fed without any likelihood of deflections of the feed plate and the feed roll as in the prior art such that control of the fibers is lost. Since the fibers are effectively held and controlled at the point of transfer, a vastly improved good combing action between the licker-in and feed roll occur. Since pressure is applied incrementally every two inches, extreme pressures as used in conventional feed assemblies in an attempt to control fibers along the roll with thickness variation is not required which reduces fiber breakage.

While a preferred embodiment of the invention has been described using specific terms, such description is for illustrative purposes only, and it is to be understood that changes and variations may be made without departing from the spirit or scope of the following claims.

What is claimed is:

1. Apparatus for feeding a lap of fibers to a carding machine of the type which includes a feed roll which feeds fibers to a licker-in roll and a feed plate over which a layer of said fibers are conveyed to the feed roll, said apparatus comprising:

a plurality of individual segmented presser means carried adjacent said feed roll; and means mounting said presser means to be individually movable towards and away from said feed roll;

said individual segmented presser means being arranged generally side-by-side continuously without interruption across the entire length of said feed roll for applying an even uniform pressure segmentally to segments of the lap of fibers continuously across the width of the lap for retaining control of fibers at the nip of said rolls should a fiber lump raise one of the presser means above the other presser means; and biasing means urging said presser means individually toward said feed roll exerting an even pressure against said lap of fibers along said feed roll regardless of the thickness of said layer of fibers.

2. The apparatus of claim 1 wherein each said presser means includes a presser lever having a concave feeder surface carried adjacently above said feeder roll to define a gap therebetween including a nose portion terminating closely adjacent a point of transfer of said fibers from said feed roll to the licker-in roll.

3. The apparatus of claim 2 including stop means limiting movement of said presser lever toward said feed roll.

* * * * *